United States Patent [19]

Rende

[11] 4,414,060

[45] * Nov. 8, 1983

[54] METHOD FOR SULFITE PULPING USING WATER-SOLUBLE MOLYBDENUM CONTAINING COMPOUNDS

[75] Inventor: Dominic S. Rende, Woodridge, Ill.

[73] Assignee: Nalco Chemical, Oak Brook, Ill.

[ * ] Notice: The portion of the term of this patent subsequent to Aug. 31, 1999 has been disclaimed.

[21] Appl. No.: 337,808

[22] Filed: Jan. 8, 1982

Related U.S. Application Data

[63] Continuation-in-part of Ser. No. 216,749, Dec. 16, 1980, abandoned.

[51] Int. Cl.[3] ..... D21C 3/04; D21C 11/02

[52] U.S. Cl. ..... 162/36; 162/39; 162/79; 162/83

[58] Field of Search ..... 162/79, 83, 65, 39, 162/45, 35, 36; 422/19; 423/53, 606

[56] References Cited

U.S. PATENT DOCUMENTS

| | | | |
|---|---|---|---|
| 1,840,413 | 12/1932 | Schmidt | 162/79 |
| 1,860,431 | 5/1932 | Richter | 162/79 |
| 2,249,646 | 7/1941 | Bragg | 162/79 |
| 3,656,888 | 4/1972 | Barry et al. | 423/606 |
| 4,176,059 | 11/1979 | Suzuki | 422/19 |
| 4,218,284 | 8/1980 | Hullman et al. | 162/79 |

*Primary Examiner*—Steve Alvo

*Attorney, Agent, or Firm*—John G. Premo; Robert A. Miller

[57] ABSTRACT

A process for sulfite pulping of wood of the type which comprises sulfite pulping wood chips in the presence of a catalytic amount of a water-soluble molybdenum containing compound, the improvement which comprises using as the source of water-soluble molybdenum containing compound molybdenum sulfide which is added to the sulfite pulping process at a point whereby it is oxidized to an oxide of molybdenum prior to being added to the chip digester.

3 Claims, 1 Drawing Figure

MOLYBDENUM DISULFIDE ADDITION POINTS FOR EXPERIMENTS #1 AND #2

PULPING PARAMETERS: 7.8% TOTAL $SO_2$; 2.0% COMBINED AS MgO; 5.5:1 LIQUOR TO WOOD RATIO; 135 MINUTES AT 135 °C; FURNACE OPERATED AT 700° C

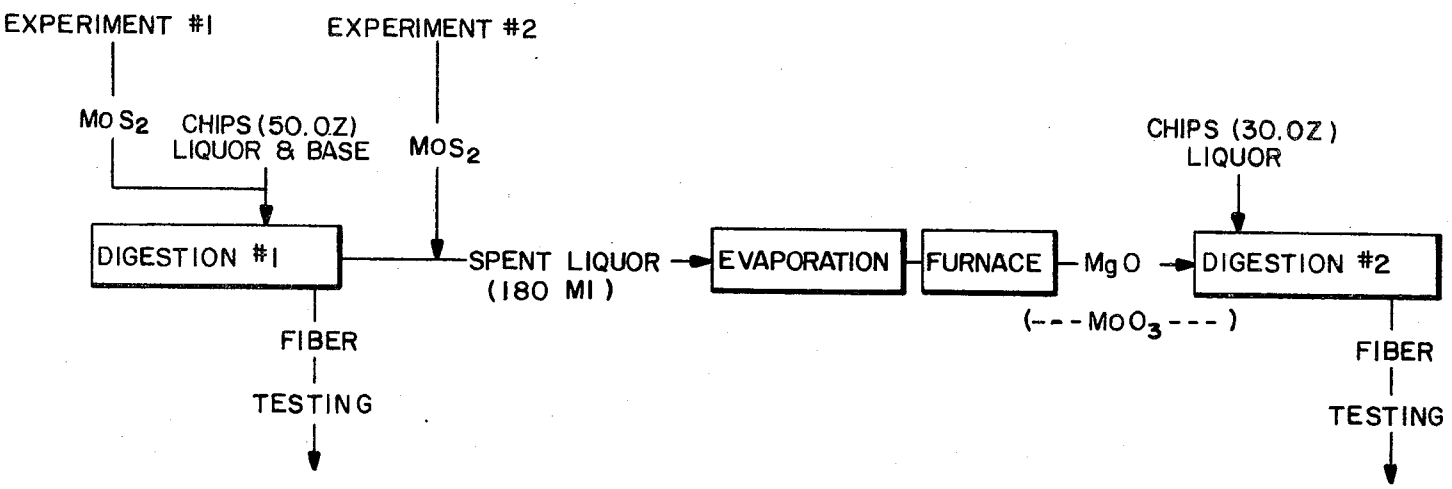
MOLYBDENUM DISULFIDE ADDITION POINTS FOR EXPERIMENTS #1 AND #2
PULPING PARAMETERS: 7.8% TOTAL $SO_2$;
2.0% COMBINED AS MgO; 5.5:1 LIQUOR TO WOOD RATIO;
135 MINUTES AT 135 °C; FURNACE OPERATED AT 700° C

METHOD FOR SULFITE PULPING USING WATER-SOLUBLE MOLYBDENUM CONTAINING COMPOUNDS

This application is a Continuation-In-Part of copending application Ser. No. 216,749 filed Dec. 16, 1980, now abandoned.

INTRODUCTION

The sulfite pulping of wood is a well known process and is described extensively in *Pulp and Paper Science and Technology*, Volume 1, Pulp, edited by C. Earl Libby, McGraw-Hill Book Company, 1962, Chapter 10, the disclosure of which is incorporated herein by reference. Recently certain transition metals and various organic compounds have been reported as aqueous alkaline pulping catalysts. While these materials have shown some effectiveness, they do not sufficiently improve the process to the point that they are used to any extent commercially.

In my earlier application, Ser. No. 168,923, filed July 14, 1980, entitled, "Molybdenum Compounds as Sulfite Pulping Catalysts," the disclosure of which is incorporated herein by reference, I have shown that the addition of catalytic amounts of molybdenum, introduced as water-soluble molybdenum compounds to the sulfite-pulping liquors, substantially increases the rate of lignin removal during chip digestion. By the use of a preferred catalyst, ammonium molybdate (0.025% as Mo based on oven-dried chip mass,) the time required to delignify softwood chips in sulfite liquor at a maximum pulping temperature of 135° C. is reduced to approximately 75% of that necessary to remove the same amount of lignin without a catalyst.

The water soluble molybdates, which include the commercial sodium and ammonium forms, accelerate the acid hydrolysis of wood lignins. This accelerated rate of reaction greatly reduces the time necessary to achieve a desired lignin content. However, the water insoluble species such as molybdenum disulfide have not provided the same level of catalysis as have the molybdates. This phenomena may be due to either a solubility or valence difference.

THE INVENTION

A process for sulfite pulping of wood of the type which comprises sulfite pulping wood chips in the presence of a catalytic amount of a water-soluble molybdenum containing compound, the improvement which comprises using as the source of water-soluble molybdenum containing compound molybdenum sulfide which is added to the sulfite pulping process at a point whereby it is oxidized to an oxide of molybdenum prior to being added to the chip digester.

The sulfite pulping operation employs a reactant mixture of sulfurous acid and a base+bisulfite ions to convert wood chips into fiber. Sulfur dioxide hydrolyzes wood lignins by modifying and/or degrading the polymer into a water soluble acid. Following this digestion, the spent liquor containing the dissolved organics and the pulping base (be it magnesium or calcium) is evaporated to a 50–75% solids level and is burned in a recovery furnace. The resulting oxides are recycled to prepare fresh cooking liquor.

Native molybdenite ($MoS_2$) is commercially roasted to $MoO_3$ via a process similar to the recovery system of a pulp mill. It is therefore possible to oxidize $MoS_2$ to the water soluble molybdate ion through this same recovery system. To support this application, two experiments were run which differed only in the point of application. Each experiment required 2 distinct digestions of fresh wood chips separated by the evaporative and burning stages of liquor recycling. The Drawing shows the pulping, evaporative, and burning stages. Parameters employed in the pulping process are also shown in the Drawing. Molybdenum disulfide was added either to the first digestive step or to the evaporation step of the recovery system as outlined in the Drawing. The degree of catalysis provided by $MoS_2$ or the oxidized $MoO_3$ forms was measured by the Kappa number of pulp (the amount of permanganate reducing compounds, as lignin, remaining in the fiber). Lower Kappa numbers reflect lower lignin content and, therefore, catalysis when reactions occur at identical pulping parameters. The data derived from these studies is shown in Table I.

TABLE 1

EFFECT OF MOLYBDENUM DISULFIDE ON THE SULFITE PULPING OF WOOD

EXPERIMENT 1: MOLYBDENUM DISULFIDE ADDITION TO SULFITE LIQUOR DURING CHIP DIGESTION #1.

| | | RESULTS: DIGESTION #1 | | RESULTS: DIGESTION #2 | |
|---|---|---|---|---|---|
| COOK NO. | TREATMENT | KAPPA NO. | % TOTAL YIELD | KAPPA NO. | % TOTAL YIELD |
| 1 | NONE | 16.0 | 47.9 | 17.6 | 48.4 |
| 2 | NONE | 16.0 | 47.9 | 17.9 | 48.7 |
| 3 | NONE | 15.2 | 48.2 | 16.3 | 48.0 |
| 4 | 0.025% Mo[1] | 14.7 | 47.6 | 12.1 | 47.2 |
| 5 | 0.025% Mo | 14.6 | 47.7 | 10.9 | 46.3 |
| 6 | 0.025% Mo | 15.0 | 48.1 | 12.9 | 47.0 |

EXPERIMENT 2: MOLYBDENUM DISULFIDE ADDITION TO SPENT SULFITE LIQUOR FROM CHIP DIGESTION #1

| | RESULTS: DIGESTION | | | RESULTS: DIGESTION #2 | |
|---|---|---|---|---|---|
| COOK NO. | KAPPA NO. | % TOTAL YIELD | TREATMENT | KAPPA NO. | % TOTAL YIELD |
| 7 | 16.2 | 48.3 | NONE | 16.3 | 48.2 |
| 8 | | | NONE | 16.1 | 48.0 |
| 9 | | | NONE | 16.3 | 48.1 |
| 10 | 16.0 | 48.2 | 0.0125% Mo[2] | 13.8 | 47.2 |
| 11 | | | 0.0125% Mo | 14.8 | 47.7 |
| 12 | | | 0.0125% Mo | 12.3 | 47.0 |

[1]As $MoS_2$ BASED ON CHIP MASS
[2]As $MoS_2$ BASED ON CHIP MASS

From the data presented in Table I, it becomes apparent that if the molybdenum sulfide is added to the digester without prior oxidation, it is ineffective. When it is added to the digester and then allowed to pass with the spent liquor into the evaporation-furnace section and thence returned to the digester, it is effective for the purposes of the invention.

The amount of water-soluble molybdenum compound produced by the teachings of this invention capable of decreasing the pulping time in the sulfite process may vary. Generally, as little as 0.0025% by weight of molybdenum based on wood has proven to be effective with a dosage range between 0.005–0.100% representing a generalized range of molybdenum that can be employed to hasten the sulfite reaction that dissolves the lignins in wood fibers.

A preferred dosage range of molybdenum is between 0.005–0.025%. It is understood that larger amounts of molybdenum offer increased catalysis.

Having thus described my invention, it is claimed as follows:

1. An improved process for sulfite pulping of wood of the type which comprises sulfite pulping wood chips in the presence of a catalytic amount of a water-soluble molybdenum containing compound, the improvement which comprises adding to the spent liquor stream in the sulfite pulping process a catalytically effective amount of molybdenum disulfide, feeding the spent liquor stream into an evaporator and recovery furnace, heating the stream to evaporate excess liquid, and oxidizing said molybdenum sulfide to recover molybdenum oxides, and then returning these molybdenum oxides to a digester wherein the molybdenum oxides act as catalysts to accelerate the acid hydrolysis of wood lignins.

2. The method of claim 1 wherein the molybdenum disulfide is added so as to provide at least 0.0025 weight percent molybdenum based on the weight of the wood chips.

3. The method of claim 1 wherein molybdenum disulfide is added so as to provide between 0.005–0.025 weight percent molybdenum based on the weight of the wood chips.

* * * * *